United States Patent [19]

Giggard

[11] 4,185,758

[45] Jan. 29, 1980

[54] COMPARTMENTALIZED AEROSOL CONTAINER

[75] Inventor: Earl D. Giggard, Clarendon Hills, Ill.

[73] Assignee: The Continental Group, Inc., New York, N.Y.

[21] Appl. No.: 930,097

[22] Filed: Aug. 1, 1978

[51] Int. Cl.[2] ..... B65D 35/14; B65D 35/28

[52] U.S. Cl. ..... 222/386.5; 53/470; 156/227; 220/67; 220/461

[58] Field of Search ..... 222/386.5, 94, 95; 53/470; 156/227; 29/458, 509; 220/67, 461, 462, 403, 404, 410

[56] References Cited

U.S. PATENT DOCUMENTS

| | | | |
|---|---|---|---|
| 3,129,867 | 4/1964 | Schroeder | 220/462 |
| 3,393,842 | 7/1968 | Bruce et al. | 222/386.5 |

FOREIGN PATENT DOCUMENTS

| | | | |
|---|---|---|---|
| 1014909 | 8/1977 | Canada | 222/386.5 |

*Primary Examiner*—David A. Scherbel
*Attorney, Agent, or Firm*—Charles E. Brown

[57] ABSTRACT

A compartmentalized aerosol container wherein there is incorporated a bag for separating the propellant from the product. In addition, the inner surface of the upper end unit is provided with a covering. The bag and the covering are formed of suitable plastics materials which are heat bondable together and during or after the completion of the seaming operation securing the end unit to the container body, the customarily formed double seam is heated to effect bonding of the end unit covering to the bag.

6 Claims, 2 Drawing Figures

COMPARTMENTALIZED AEROSOL CONTAINER

This invention relates in general to new and useful improvements in containers, and more particularly to an aerosol type container having a separate compartment for receiving the product to be dispensed.

It is known to provide aerosol type containers which include a bag in which the product is contained separate and apart from the propellant. Further, it is known to incorporate the upper edge of the bag in the seam between the top end closure and the container body. However, during the formation of the normal double seam between the end closure and the container body the bag is frequently ruptured.

Another deficiency of existing aerosol type containers having a separate bag for the product is that although the bag may be formed of a suitable plastics material which will not be attacked or corroded by the product, this is not true of the end unit.

In accordance with this invention, it is proposed to provide the inner surface of the end unit with a covering which serves not only to protect the inner surface of the end unit against the product, but which is also bondable to the bag.

It is proposed in accordance with this invention to provide an end unit which has an inner surface covering and to incorporate within the container body a bag having an open end portion which is folded into the seam securing the end unit to the container body with the bag being placed in intimate contact with the inner surface covering of the end unit. Then, either during the seaming operation or after the end unit has been seamed to the body, heating the seam to a temperature wherein the inner surface covering is bonded to the bag.

A particular feature of this invention is that should the bag be fractured during the seaming, it will be fractured within the area of the seam and thus the heating of the seam will result in the automatic healing or repairing of the bag fracture.

A further advantage of the inner surface covering is that it is incorporated in the seam and serves to cushion the seam formation, thereby to prevent the bag from being cut under the localized stresses of the seaming operation.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
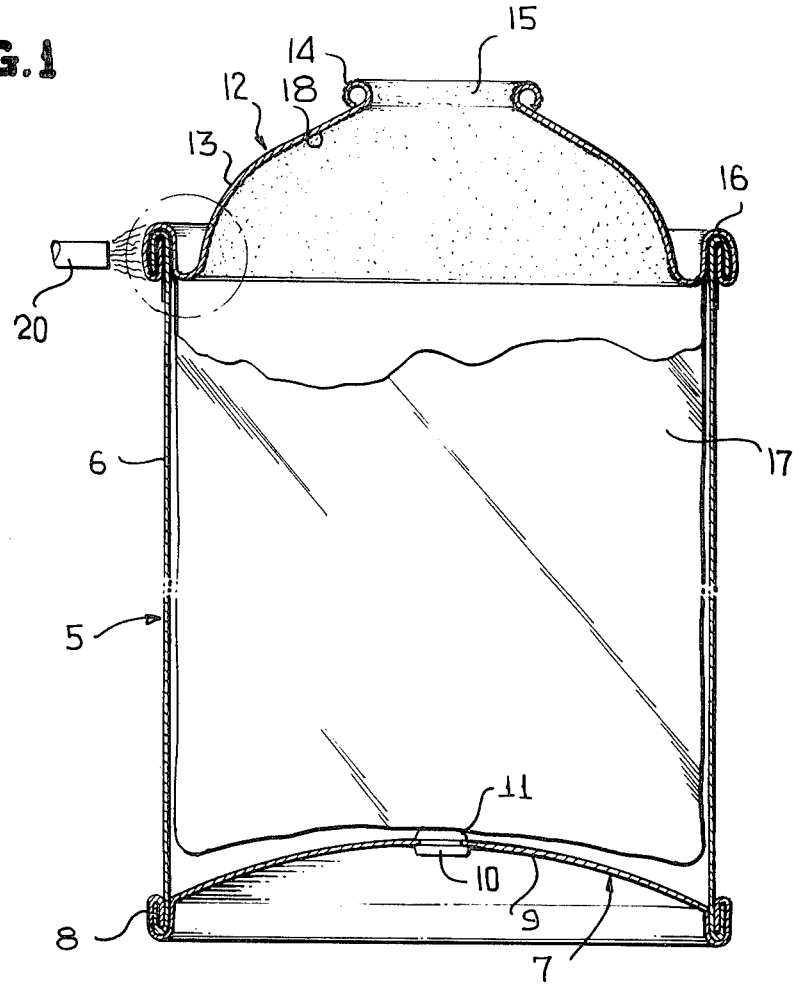
FIG. 1 is a vertical sectional view taken through an aerosol container formed in accordance with this invention, with the customary dispensing valve being omitted and prior to the filling with the product.

Referring now to the drawings in detail, it will be seen that in FIG. 1 the container is generally identified by the numeral 5 and includes a customary cylindrical body 6 which is closed at its lower end by a lower end unit 7 which is secured to the container body 6 by way of a conventional double seam 8. The end unit 7 has an upwardly domed end panel 9 which is provided with a propellant filling opening 10 which is closed by means of a plug 11.

The container 5 also includes a customary domed upper end unit 12 which includes a domed end panel 13 terminating in a curl 14. The curl 14 defines an opening 15 into which a customary aerosol valve (not shown) may be inserted.

It is to be understood that the end unit 12 is secured to the upper end of the body 6 by means of a customary double seam 16.

In order that the container 5 may be divided into two compartments, thus separating a product from a propellant, the container 5 includes a bag 17 which is formed of a suitable plastics material film. The film per se does not form a part of this invention, but normally will be formed of a laminated polyethylene or other fusible plastics material.

In the past a bag such as the bag 17 has had the upper free end portion thereof incorporated in the double seam 16. However, it has been found that frequently the bag is ruptured during the seaming operation, and thus the product is not completely retained within the bag 17 independent of the propellant.

In accordance with this invention, it is proposed to provide the inner surface of the end unit 12 with a covering 18. The covering 18 is preferably formed of a plastics material film which may be of a laminated construction and which is suitably bonded both to the end unit 12 and to the bag 17. However, it is feasible that the covering 18 be applied as a powder which is then heated so as to effect the flowing of the powder and the bonding thereof to the end unit.

In accordance with this invention, as is schematically shown in FIG. 1, a suitable heater 20 may be provided for heating the double seam 16. It is to be understood that the double seam 16 may be heated either during the forming therof or subsequent to the completion of the seaming operation.

It is particularly pointed out here that in the event there should be a rupture of the bag 17 during the seaming operation, the rupture will occur generally within the seam. Thus, the application of heat to the seam will function not only to bond the bag 17 to the covering 18, but also to heal or repair any rupture in the bag. This is particularly true since the rupture will normally occur in an area wherein the bag is engaged by the covering 18 and thus there will be a bonding of the bag to the covering 18 surrounding the fracture.

Figure 2:
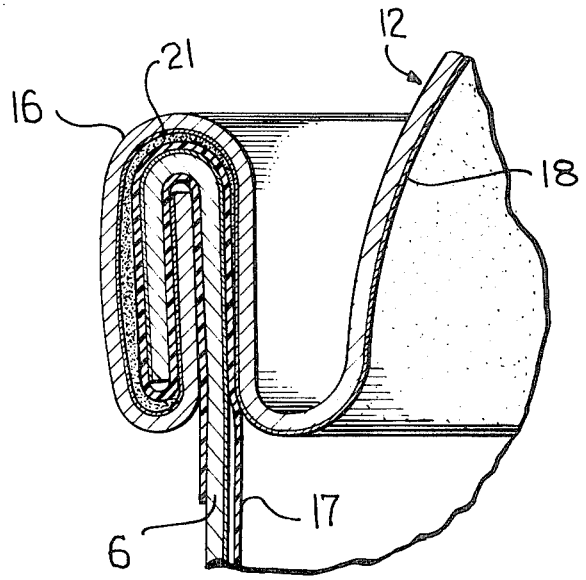
FIG. 2 is an enlarged fragmentary vertical sectional view taken through the double seam between the end unit and the container body.

As is best shown in FIG.2, the end unit 12 will normally be provided with an end sealing compound 21 in the customary manner. This sealing compound, in cooperation with the covering 18, will serve to cushion the effects of the seaming operation on the bag 17 and thus greatly reduce the possibilities of bag fracture.

It is also to be noted that by properly covering the inner surface of the end unit 12, and by effecting a complete bond between the covering 18 and the bag 17, a completely protected enclosure is provided for the product. Thus, various types of products may be packaged which otherwise would have a corrosive effect on the metal of the container.

Although only a preferred embodiment of the invention has been specifically illustrated and described herein, it is to be understood that minor variations may be made in the construction of the container without departing from the spirit and scope of the invention as defined by the appended claims. cm I claim:

1. A compartmented container comprising a metal container body, a separately formed metal end unit and a plastics material bag, said end unit being joined to said body by a folded seam including folded portions of both said end unit and said body, said bag having an open end portion entrapped in said folded seam and being subject to rupture in the formation of said seam, and said end unit having an inner surface covering bonded to said bag within said folded seam, said bag and said inner surface covering within said folded seam forming a gasket for said folded seam and forming a seal between said bag and said body, said container being a fluid pressure type dispensing container, said end unit carrying a dispensing valve, said container being subject to leakage of a pressurizing fluid between said body and said bag and a product under pressure within said bag between said bag and said end unit, said bag and said inner surface covering having opposed contacting surfaces, and said surfaces being heat bonded together in situ within said folded seam.

2. The compartmented container of claim 1 wherein said inner surface covering is a preformed film.

3. The compartmented container of claim 1 wherein said inner surface covering is a formed in situ covering formed of bonded powder particles.

4. The compartmented container of claim 1 wherein a sealing compound is disposed between said end unit and said bag in a major portion of said double seam.

5. The compartmented container of claim 1 wherein a sealing compound is disposed between said end unit and said bag in a major portion of said double seam, said end unit has a portion telescoped within said body, and said heat bonding between said bag and said end unit is with said end unit telescoped portion.

6. A method of forming a compartmented container comprising the steps of providing a metal container having an open end, placing a plastics material bag within said container body with an open free end portion of said bag extending radially outwardly from said container body at its open end, providing a metal end unit for said container body open end with said end unit having an inner surface covering heat bondable to said bag, forming a folded double seam between said end unit and said container body while bringing said end unit inner surface covering into intimate contact with said bag within said folded double seam thereby subjecting said bag to rupture within the folded double seam, and heating said inner surface covering and said bag and forming a heat seal therebetween within said folded seam while simultaneously repairing any ruptures in said bag which may have occurred during the forming of said folded double seam.

* * * * *